US005897053A

United States Patent [19]

Cirimele

[11] Patent Number: 5,897,053

[45] Date of Patent: Apr. 27, 1999

[54] MAIL SLOT BOX

[76] Inventor: Ronald Cirimele, 31 Desvio Ct., Pacifica, Calif. 94044

[21] Appl. No.: 08/785,392

[22] Filed: Jan. 21, 1997

[51] Int. Cl.[6] ..... A47G 29/12

[52] U.S. Cl. ..... 232/19; 232/17

[58] Field of Search ..... 232/19, 13, 1 E, 232/43.2, 17; 211/88.01, 55

[56] References Cited

U.S. PATENT DOCUMENTS

| | | | |
|---|---|---|---|
| 359,458 | 3/1887 | Moore | 232/19 |
| 686,954 | 11/1901 | Riley | 232/43.2 |
| 1,497,616 | 6/1924 | Tiefel | 232/45 X |
| 1,756,559 | 4/1930 | Knapp | 232/19 X |
| 2,377,713 | 6/1945 | Penney et al. | 232/43.2 X |
| 4,099,813 | 7/1978 | Olivan | 211/55 X |
| 4,162,731 | 7/1979 | DeGroot | 211/55 X |
| 4,776,512 | 10/1988 | Moore, Sr. et al. | 232/19 |
| 5,368,226 | 11/1994 | Franseschino | 232/19 |
| 5,492,272 | 2/1996 | Fewer | 232/19 |

FOREIGN PATENT DOCUMENTS

| | | | |
|---|---|---|---|
| 22079 | 11/1905 | Austria | 232/45 |
| 14340 | 6/1896 | United Kingdom | 232/45 |

*Primary Examiner*—Blair M. Johnson
*Attorney, Agent, or Firm*—Jack Lo

[57] ABSTRACT

A mail slot box includes a bottom, opposite sides, a semi-circular back, and an open top. A mounting flange extends along the front edges of the bottom and sides for mounting behind a mail slot and collecting mail delivered there-through. The semi-circular back causes the mail to rotate and stack in an orderly fashion without binding or bunching up. When mounted behind a mail slot on a garage door, the semi-circular back provides a concave surface for holding the mail and preventing it from falling out when the garage door is lifted to a horizontal open position.

2 Claims, 2 Drawing Sheets

MAIL SLOT BOX

BACKGROUND OF THE INVENTION

1. Field of the Invention

This invention relates generally to mail boxes, specifically to a mail collection box for mounting behind a mail slot.

2. Prior Art

Mail slots are typically installed through a wall or a door. In residential buildings, the slots are often installed in a garage door. When mail is delivered through such slots, it falls onto the ground, where it is scattered and dirtied. A person picking up the mail must gather up individual pieces, and perhaps dust them off.

Simple rectangular boxes with an open top have been attached behind mail slots for collecting the mail. However, the square comers tend to bind the mail, which bunches up and makes the insertion of additional mail through the slot difficult. Furthermore, when such boxes are installed behind a slot on a garage door, the mail tends to fall out when the garage door is lifted to a horizontal open position.

OBJECTS OF THE INVENTION

Accordingly an object of the present invention is to provide a mail slot box for collecting mail delivered through a mail slot.

Another object of the present invention is to provide a mail slot box that causes the mail to stack in an orderly fashion without binding.

Yet another object of the present invention is to provide a mail slot box that, if mounted on a garage door, continues to hold the mail even when the garage door is lifted to a horizontal open position.

Further objects of the present invention will become apparent from a consideration of the drawings and ensuing description.

BRIEF SUMMARY OF THE INVENTION

A mail slot box includes a bottom, opposite sides, a semi-circular back, an open top, and a mounting flange. When mounted behind a mail slot, it collects mail delivered therethrough. The semi-circular back causes the mail to rotate and stack in an orderly fashion without binding or bunching up. When mounted behind a mail slot on a garage door, the semi-circular back also holds the mail and prevents it from falling out when the garage door is lifted to a horizontal open position.

DRAWING REFERENCE NUMERALS

10. Mail Slot Box 11. Bottom

12. Side 13. Side

14. Semi-Circular Back 15. Top Opening

16. Holes 17. Flange

18. Vertical Structural Member 19. Mail Slot

20. Screws 21. Mail

DETAILED DESCRIPTION OF THE INVENTION

Figure 1:
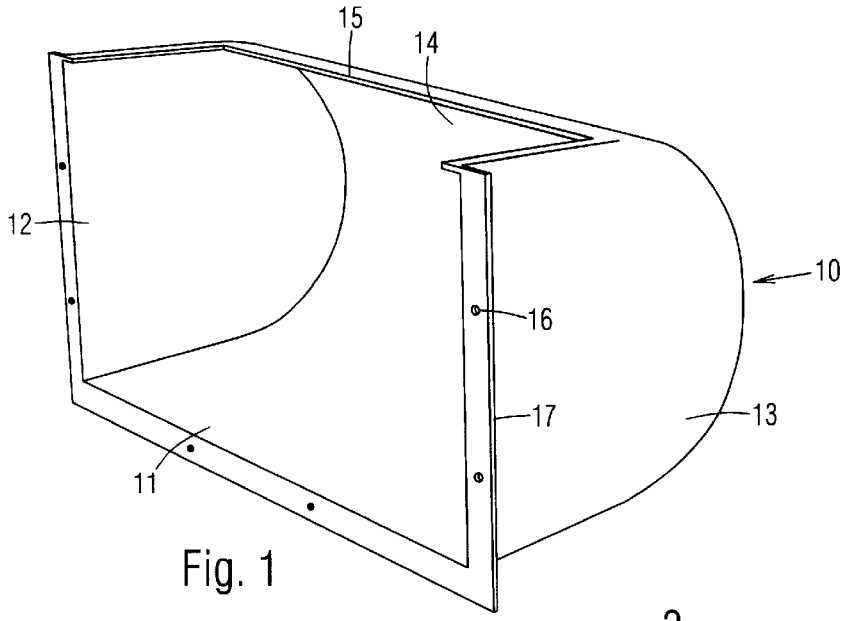
FIG. 1 is a front perspective view of a mail slot box.
Figure 2:
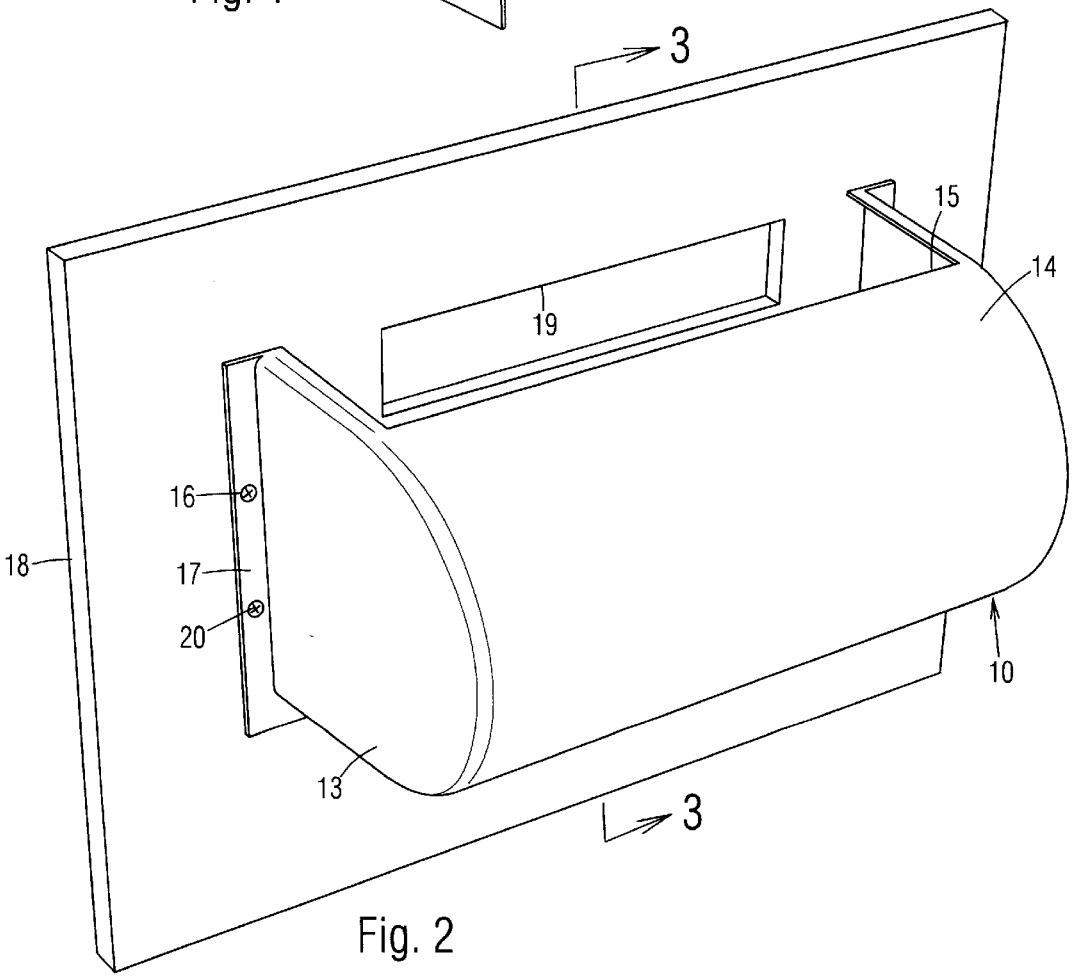
FIG. 2 is a rear perspective view of the mail slot box when mounted behind a mail slot.

FIG. 1:

In accordance with a preferred embodiment of the invention shown in the front perspective view of FIG. 1, a mail slot box 10 includes a horizontal bottom 11, vertical opposite sides 12 and 13, a rearwardly bowing semi-circular back 14, and a top opening 15 extending from the front of the box to the top edge of semi-circular back 14. The depth of top opening 15 is about 50% of the depth of the box. Screw holes 16 are arranged on a mounting flange 17 extending along the front edges of bottom 11 and sides 12 and 13.

FIG. 2:

Mail slot box 10 is shown mounted on a vertical planar structure or wall 18 behind a mail slot 19. Screws 20 are positioned through holes 16.

Figure 3:
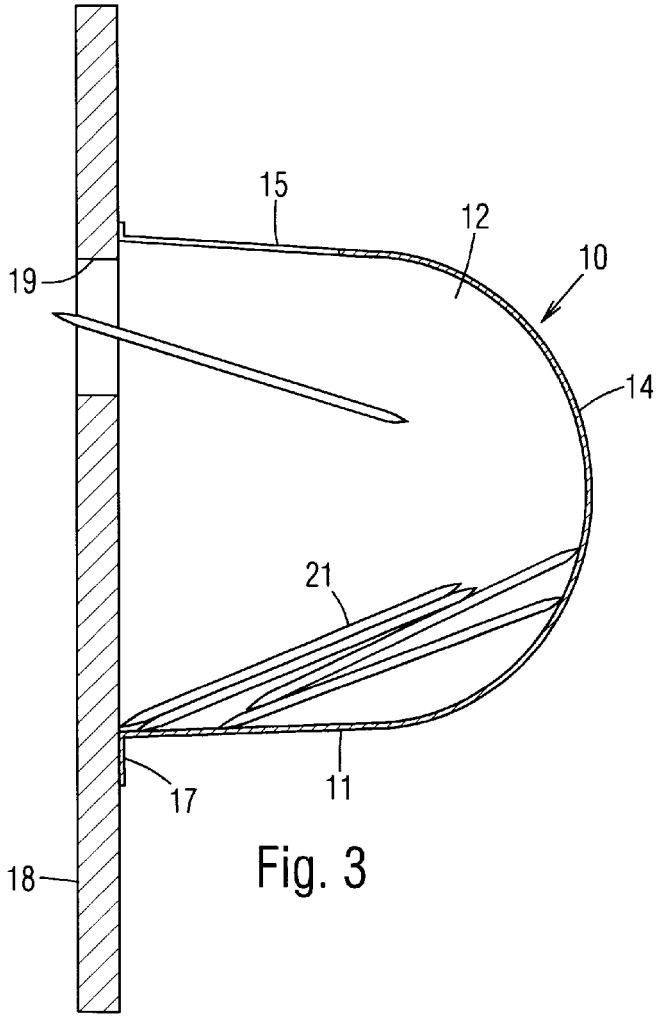
FIG. 3 is a side sectional view of the mail slot box, taken along line 3—3 in FIG. 2.

FIG. 3:

When mail 21 is delivered through mail slot 19, it is collected in mail slot box 10, as shown in FIG. 3. Semi-circular back 14 causes mail 21 to rotate thereon and stack in an orderly fashion without binding or bunching, so that additional mail can be inserted easily, and the space in mail slot box 10 is used efficiently.

Figure 4:
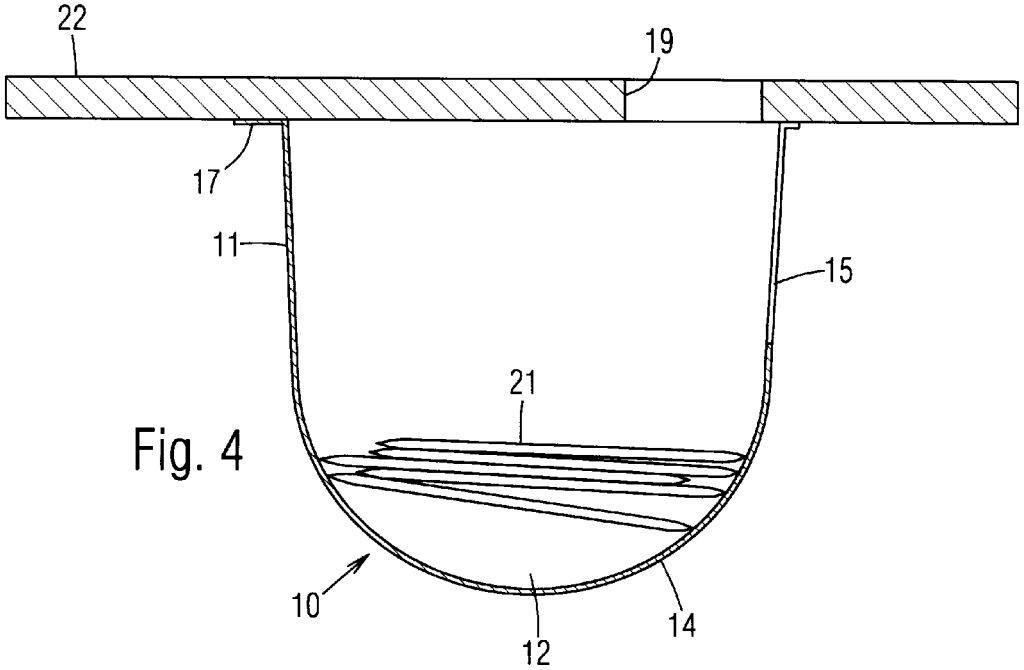
FIG. 4 is a side sectional view of the mail slot box when the garage door is lifted to a horizontal open position.

FIG. 4:

When mail slot box 10 is mounted on a garage door 22, semi-circular back 14 provides a concave surface for containing mail 21 and preventing it from falling out when door 22 is lifted to a horizontal open position, as shown in FIG. 4.

SUMMARY AND SCOPE

Accordingly, I have provided a mail slot box for collecting mail delivered through a mail slot. It causes the mail to stack in an orderly fashion without binding or bunching. When it is mounted on a garage door, it continues to hold the mail even when the garage door is lifted to a horizontal open position.

Although the above descriptions are specific, they should not be considered as limitations on the scope of the invention, but only as examples of the embodiments. Many substitutes and variations are possible within the teachings of the invention. For example, instead of being flat, the bottom may be formed by an arcuate portion of the semi-circular back. Instead of half a circle, the back may form a greater or lesser portion of a circle, and it may be less circular, but still substantially curved. The top opening may be enlarged to about 75% of the depth of the box. Therefore, the scope of the invention should be determined by the appended claims and their legal equivalents, not by the examples given.

I claim:

1. A mail in combination with a garage door slot box for collecting mail, comprising:

a horizontal bottom having a front edge, a rear edge, and opposite side edges;

opposite vertical sides extending upwardly from said side edges of said bottom;

a rearward bowing semi-circular back extending between said vertical sides and having a lower edge connected to said rear edge of said bottom;

a top opening positioned between said vertical sides and forward of an upper edge of said semi-circular back; and a front opening between said front edge of said horizontal bottom and a front of said top opening, and between said vertical sides, said mail slot box is attached to said garage door so that said front opening is aligned behind a mail slot extending through said garage door, said garage door is movable between a vertical position and a horizontal position, said mail slot box completely surrounding said mail slot for positively catching mail delivered therethrough, said semi-circular back adapted for rotating said mail to prevent binding, said semi-circular back for supporting said mail even when said garage door is moved to said horizontal position and said mail slot box is positioned under said garage door, said top opening being higher than said semi-circular back said when said garage door is in said horizontal position for preventing said mail from falling out said top opening.

2. A method for collecting mail delivered through a mail slot on a garage door movable between a vertical position and a horizontal position, comprising the steps of: providing a mail slot box comprising:

a horizontal bottom having a front edge, a rear edge, and opposite side edges;

opposite vertical sides extending upwardly from said side edges of said bottom;

a rearward bowing semi-circular back extending between said vertical sides and having a lower edge connected to said rear edge of said bottom;

a top opening positioned between said vertical sides and forward of an upper edge of said semi-circular back; and a front opening between said front edge of said horizontal bottom and a front of said top opening, and between said vertical sides; and attaching said mail slot box to said garage door so that said front opening is aligned behind said mail slot, said mail slot box completely surrounding said mail slot for positively catching mail delivered therethrough, said semi-circular back rotating said mail to prevent binding, said semi-circular back supporting said mail even when said garage door is moved to said horizontal position and said mail slot box is positioned under said garage door, said top opening being higher than said semi-circular back said when said garage door is in said horizontal position for preventing said mail from falling out said top opening.

* * * * *